US008049685B2

(12) United States Patent
Miller et al.

(10) Patent No.: US 8,049,685 B2
(45) Date of Patent: Nov. 1, 2011

(54) PASSIVE MATRIX THIN-FILM ELECTRO-LUMINESCENT DISPLAY

(75) Inventors: Michael E. Miller, Honeoye Falls, NY (US); Ronald S. Cok, Rochester, NY (US)

(73) Assignee: Global OLED Technology LLC, Herndon, VA (US)

( * ) Notice: Subject to any disclaimer, the term of this patent is extended or adjusted under 35 U.S.C. 154(b) by 1060 days.

(21) Appl. No.: 11/558,093

(22) Filed: Nov. 9, 2006

(65) Prior Publication Data

US 2008/0111771 A1 May 15, 2008

(51) Int. Cl.
*G09G 3/30* (2006.01)

(52) U.S. Cl. ..... 345/76; 315/169.3; 345/82; 345/204

(58) Field of Classification Search ..... 345/1.1–111, 345/204–215, 690–699; 315/169.3
See application file for complete search history.

(56) References Cited

U.S. PATENT DOCUMENTS

| | | | | |
|---|---|---|---|---|
| 4,528,561 | A * | 7/1985 | Kitamura | 345/698 |
| 4,769,292 | A | 9/1988 | Tang et al. | |
| 4,821,208 | A * | 4/1989 | Ryan et al. | 345/550 |
| 5,025,394 | A * | 6/1991 | Parke | 345/475 |
| 5,061,569 | A | 10/1991 | VanSlyke et al. | |
| 5,488,674 | A * | 1/1996 | Burt et al. | 382/284 |
| 5,488,687 | A * | 1/1996 | Rich | 345/563 |
| 5,612,715 | A * | 3/1997 | Karaki et al. | 345/698 |
| 5,642,125 | A * | 6/1997 | Silverstein et al. | 345/87 |
| 5,644,324 | A * | 7/1997 | Maguire, Jr. | 345/9 |
| 5,696,531 | A * | 12/1997 | Suzuki et al. | 345/698 |
| 5,703,436 | A * | 12/1997 | Forrest et al. | 313/506 |
| 5,726,670 | A * | 3/1998 | Tabata et al. | 345/7 |
| 5,808,589 | A * | 9/1998 | Fergason | 345/8 |
| 6,078,427 | A * | 6/2000 | Fontaine et al. | 359/630 |
| 6,094,182 | A * | 7/2000 | Maguire, Jr. | 345/9 |
| 6,222,675 | B1 * | 4/2001 | Mall et al. | 359/630 |
| 6,274,980 | B1 * | 8/2001 | Burrows et al. | 313/506 |
| 6,304,245 | B1 * | 10/2001 | Groenenboom | 345/611 |
| 6,396,507 | B1 * | 5/2002 | Kaizuka et al. | 345/661 |
| 6,486,607 | B1 | 11/2002 | Yeuan | |
| 6,614,448 | B1 * | 9/2003 | Garlick et al. | 345/605 |

(Continued)

FOREIGN PATENT DOCUMENTS

WO 2006/035248 4/2006

OTHER PUBLICATIONS

U.S. Appl. No. 11/226,622, filed Sep. 14, 2005, Kahen.

(Continued)

*Primary Examiner* — Lun-Yi Lao
*Assistant Examiner* — Gene W Lee
(74) *Attorney, Agent, or Firm* — Morgan, Lewis & Bockius LLP

(57) ABSTRACT

A passive-matrix, thin-film electro-luminescent display system includes a display having a substrate with organic layers and orthogonally arranged electrodes formed thereon. One or more display drivers: (i) receives an input image signal for addressing the light-emitting elements of the display; (ii) decomposes the signal into a low-resolution component signal and a high-resolution component signal, wherein the low-resolution component signal contains one half or less of the number of addressable locations as the high-resolution component signal; and (iii) that provides a drive signal for driving the display wherein the low-resolution component signal and the high-resolution component signal are independently provided to the display to form a combined image.

16 Claims, 9 Drawing Sheets

U.S. PATENT DOCUMENTS 6,639,706 B2 * 10/2003 Ziv et al. ..... 359/238
6,657,603 B1 * 12/2003 Demetrescu et al. ..... 345/32
6,677,948 B1 * 1/2004 Wasserman et al. ..... 345/428
6,724,353 B2 * 4/2004 Ophey ..... 345/8
6,734,838 B1 * 5/2004 Eichenlaub ..... 345/87
6,781,606 B2 * 8/2004 Jouppi ..... 345/698
6,819,649 B1 * 11/2004 Magnitski et al. ..... 369/126
6,850,352 B1 * 2/2005 Childers ..... 359/237
6,873,343 B2 * 3/2005 Chui ..... 345/667
6,898,331 B2 * 5/2005 Tiana ..... 382/274
6,909,233 B2 * 6/2005 Cok et al. ..... 313/506
6,958,761 B2 * 10/2005 Yim et al. ..... 345/698
6,980,182 B1 12/2005 Nimmer et al.
7,081,870 B2 * 7/2006 Bronson ..... 345/7
7,123,780 B2 * 10/2006 Carrig ..... 382/299
7,142,179 B2 * 11/2006 Miller et al. ..... 345/76
7,206,002 B2 * 4/2007 Kawamoto ..... 345/673
7,218,328 B2 * 5/2007 Blackham et al. ..... 345/545
7,333,071 B2 * 2/2008 Baudisch et al. ..... 345/1.3
7,417,617 B2 * 8/2008 Eichenlaub ..... 345/102
7,495,638 B2 * 2/2009 Lamvik et al. ..... 345/76
7,528,810 B2 * 5/2009 Ohshima et al. ..... 345/77
7,609,230 B2 * 10/2009 Dispoto et al. ..... 345/48
7,629,945 B2 * 12/2009 Baudisch ..... 345/1.3
7,633,473 B2 * 12/2009 Uh et al. ..... 345/87
7,782,310 B2 * 8/2010 Wang ..... 345/204
2002/0101179 A1 8/2002 Kawashima
2002/0113782 A1 * 8/2002 Verberne et al. ..... 345/204
2002/0167458 A1 * 11/2002 Baudisch et al. ..... 345/1.1
2002/0167459 A1 * 11/2002 Baudisch et al. ..... 345/1.3
2002/0167460 A1 * 11/2002 Baudisch et al. ..... 345/3.3
2002/0167461 A1 * 11/2002 Bronson ..... 345/7
2003/0030613 A1 * 2/2003 Chae ..... 345/89
2003/0170491 A1 * 9/2003 Liao et al. ..... 428/690
2003/0193463 A1 * 10/2003 Yamada et al. ..... 345/88
2004/0061710 A1 * 4/2004 Messing et al. ..... 345/698
2004/0145536 A1 * 7/2004 Stephany et al. ..... 345/3.1
2004/0218818 A1 * 11/2004 Clare et al. ..... 382/232
2004/0227703 A1 * 11/2004 Lamvik et al. ..... 345/76
2004/0251820 A1 * 12/2004 Cok et al. ..... 313/506
2005/0116968 A1 * 6/2005 Barrus et al. ..... 345/698
2005/0219163 A1 10/2005 Smith et al.
2005/0264589 A1 * 12/2005 Kimoto et al. ..... 345/698
2007/0139354 A1 * 6/2007 Kim et al. ..... 345/102
2007/0285416 A1 * 12/2007 Wang ..... 345/213
2008/0024390 A1 * 1/2008 Baker et al. ..... 345/1.3

OTHER PUBLICATIONS

U.S. Appl. No. 11/536,712, filed Sep. 26, 2006, Cok.

* cited by examiner

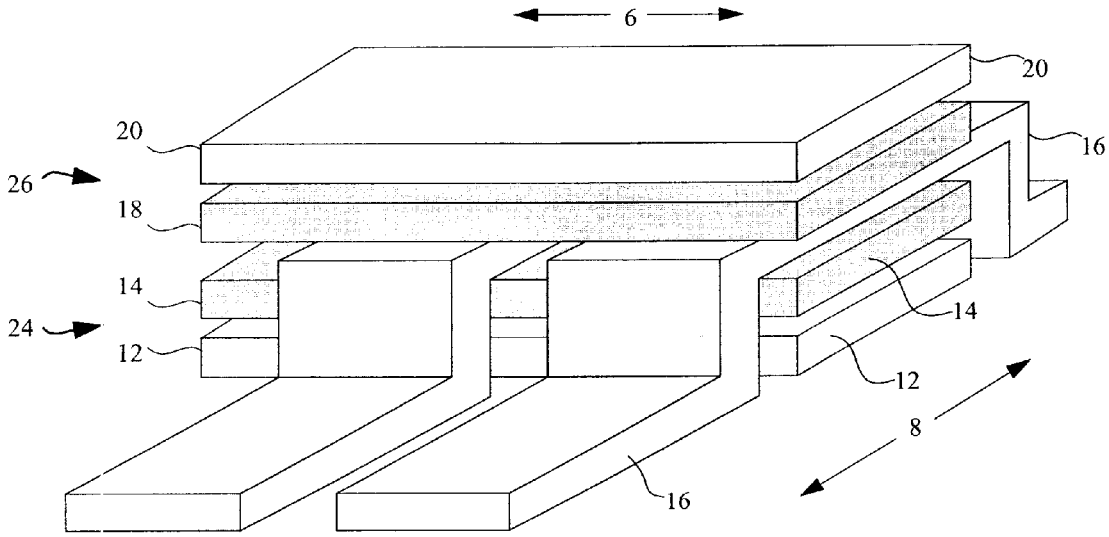
Fig. 5
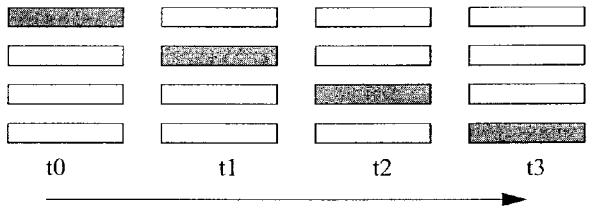
Fig. 6 - Prior art

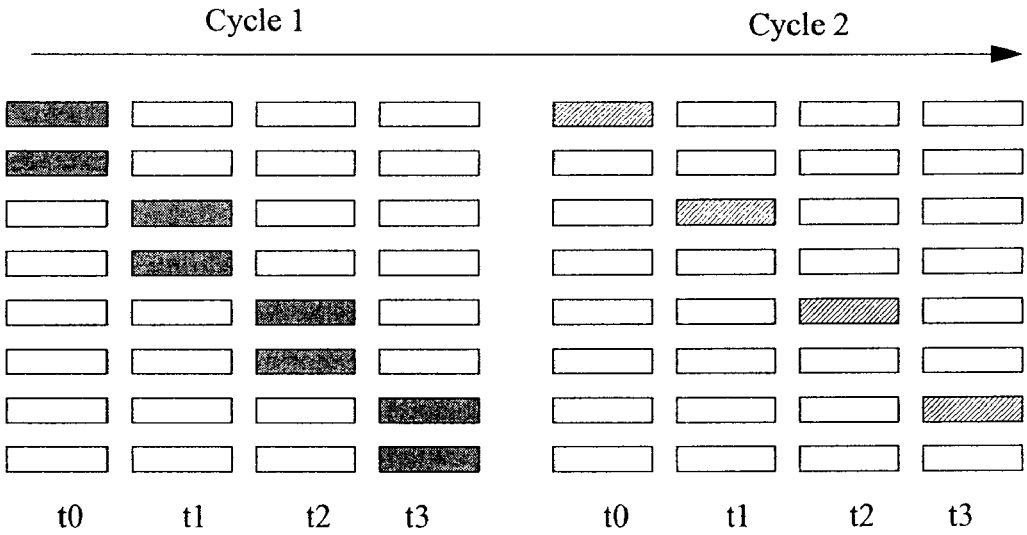
Fig. 11A
Fig. 11B
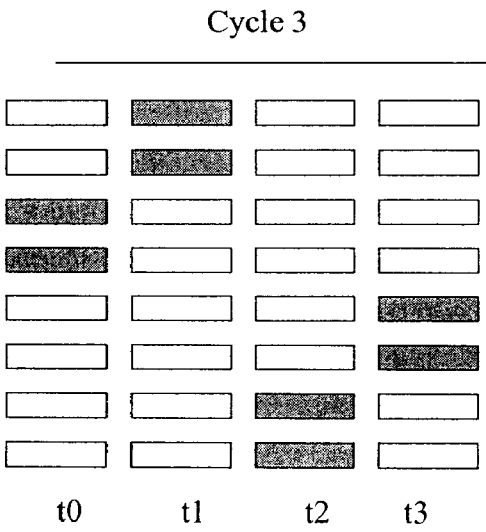
Fig. 11C
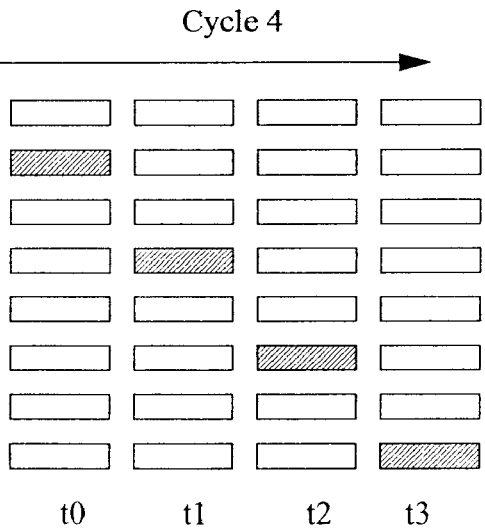
Fig. 11D

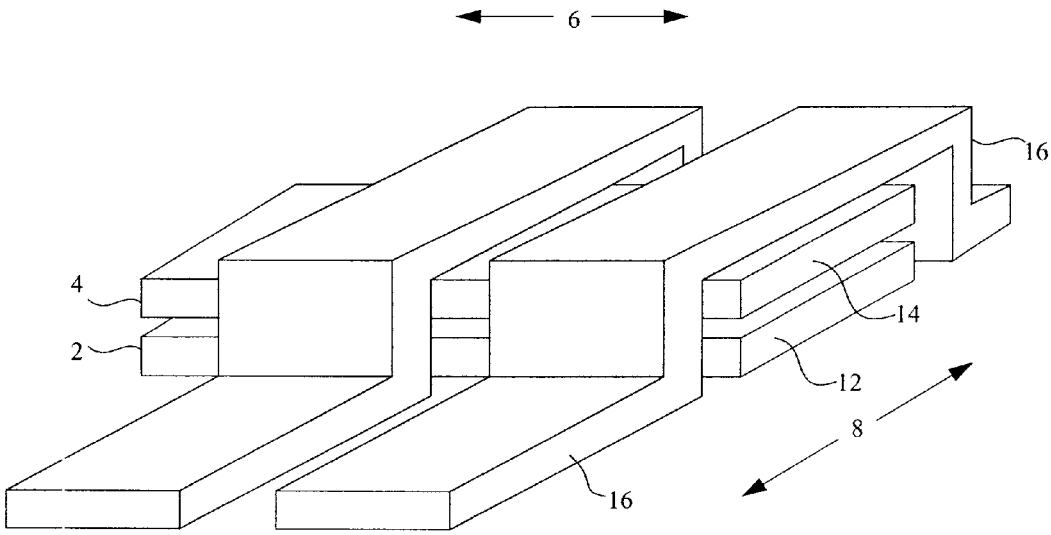
Fig. 13 - prior art
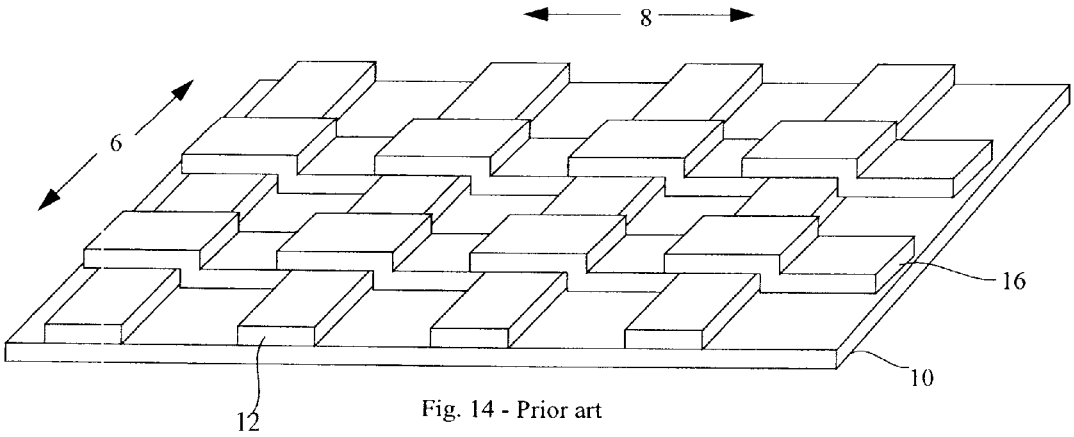
Fig. 14 - Prior art

PASSIVE MATRIX THIN-FILM ELECTRO-LUMINESCENT DISPLAY

FIELD OF THE INVENTION

The present invention relates to passive matrix thin-film electro-luminescent display systems and specifically a method for driving them to decrease their refresh rate and power consumption.

BACKGROUND OF THE INVENTION

Numerous technologies for forming flat-panel displays are known in the art. One such technology is the electro-luminescent display, which is formed by coating a thin layer of electro-luminescent material between a pair of electrodes. Displays employing this technology produce light as a function of the current between the two electrodes when the electro-luminescent materials are electrically stimulated. Electro-luminescent displays are primarily classified as active-matrix or passive-matrix displays. Active-matrix displays employ a relatively complex, active circuit at each pixel in the display to control the flow of current through the electro-luminescent material layer(s). The formation of this active circuit at each pixel can be expensive and often the performance of these circuits is somewhat limited. Passive-matrix displays are much simpler in their construction. Each pair of electrodes at each pixel is formed by the intersection of a row and a column electrode. As this type of display does not require the costly formation of active circuits at each pixel site, they are much less expensive to construct.

Referring to FIGS. 13 and 14, a prior-art display is illustrated having electrodes 12 and 16 with an electro-luminescent layer 14 formed between the electrodes 12 and 16 and responsive to a current provided by the electrodes 12 and 16 to produce light. The two electrodes 12 and 16 are typically patterned in orthogonal directions 8 and 6 over a substrate 10 and driven by external row and column drivers (not shown) connected to the electrodes 12 and 16.

While passive-matrix displays can be much less expensive to construct than active-matrix displays, they often suffer from relatively severe operational limitations, for example, resolution and refresh rate limitations, which restrict the commercial application of the passive-matrix displays to small, very low-resolution displays. Because of these limitations, the typical passive-matrix thin-film EL display is less than 2 inches in diagonal and has fewer than 150 lines of light-emitting elements. One of the more severe of these limitations occurs due to the fact that the thin-film EL display is formed from a very thin layer of relatively high-resistance EL material between a pair of metal electrodes. In this configuration, the EL pixel has a very high capacitance and when driving this pixel in a display, enough current must be provided to the pixel to overcome the capacitance before the pixel can emit light. Of course, the larger the pixel, and the thinner the electro-luminescent material, the larger the capacitance and the more energy that is required to overcome this capacitance before light is produced. Therefore, large displays employing thin films of electro-luminescent materials will require significant power to overcome the capacitance of the pixels in the display.

This power issue is further worsened for passive-matrix displays having a relatively higher resolution as these displays are typically addressed by placing a reference voltage on a single row electrode, e.g., second electrode 16 shown in FIGS. 13 and 14, in the display and then providing pixel voltages on each column line, e.g., first electrode 12, simultaneously. In this addressing scheme, a pre-charge current is provided to each pixel to overcome the capacitance of each pixel, current is provided to the EL pixels to produce light, the voltages are then changed to switch the row of pixels into reverse bias, draining the capacitance, and then the next line is addressed. To provide a flicker-free image, this process needs to be completed for each line in the display at a rate around 70 Hz. Therefore, as the number of lines on the display is increased, the amount of power that is dissipated by charging and discharging the capacitance of the light-emitting elements in the display increases. Further, it is necessary to turn on and off a large number of rows of data at the very high rates that occur when the display has a large number of lines (e.g., significantly more than 100 lines) that have to be refreshed at a rate of 70 Hz. Accordingly, it becomes very expensive to construct drivers that are capable of providing high enough currents to perform the required process of pre-charging each pixel, providing current to light each pixel, and then providing sufficient reverse bias in order to perform this refresh process. Therefore, it is not only necessary to reduce the amount of power that is dissipated in pre-charging and reverse biasing each light-emitting element, but to also reduce the peak current that must be provided by the drivers.

Many different solutions for overcoming or avoiding these problems have been suggested. For example, U.S. Pat. No. 6,980,182, issued Dec. 27, 2005 to Nimmer et al, entitled "Display System," suggests patterning an insulating layer over a subset of the rows of the display before depositing the column lines, forming numerous layers of independently addressable row drivers. Different row and column drivers are then used to drive the different rows of the display within each layer of the row drivers. In this way, the amount of current that must be provided by any single driver is reduced as it is divided among two or more drivers. While this does make any single driver for the display less expensive, it requires multiple drivers, which can add significant cost to the overall system.

US Patent Application 2002/0101179, filed Dec. 27, 2001 by Kawashima, entitled "Organic Electroluminescence Driving Circuit, Passive Matrix Organic Electroluminescence Display Device, and Organic Electroluminescence Driving Method," suggests driving the passive-matrix display using two power supplies. The first power supply serves as a "voltage holding" supply. The second of these power supplies is used to provide current to activate the light-emitting elements of the display (i.e., provide current to light each light-emitting element). In such a device, all but the active light-emitting elements are attached to the voltage holding supply. This power supply maintains the charge in the capacitors at or near the threshold of the light-emitting diodes such that the light-emitting elements do not have to be charged or discharged. Besides adding the cost of a second power supply, such displays will often have leakage current near this threshold, and therefore require power to be dissipated even when the display is intended to be dark, which of course also elevates the black level of the display somewhat as the light-emitting elements will produce a small amount of light in response to this leakage current.

A similar approach is employed in U.S. Pat. No. 6,486,607, issued Nov. 26, 2002, by Yeuan, entitled "Circuit and System for Driving Organic Thin-Film Elements," which discusses an electronic circuit that allows the light-emitting elements to be pre-charged via the row line on the cathode while constant current is provided via the column line, attached to the anode. In this way, the light-emitting elements may be pre-charged by a power supply on the row drivers while a power supply on the column drivers is used to provide power to activate the light-emitting elements.

US Patent Application 2005/0219163, filed Apr. 25, 2002 by Smith et al., entitled "Display Driver Circuits for Organic Light-Emitting Diode Displays with Skipping of Blank Lines," discusses constructing a driver that contains a frame buffer and image processing methods that makes it possible to analyze the information before it is displayed. In the approach that is discussed, each row of input data is analyzed to determine if any row is substantially black. If it is, the drivers skip the line while driving the display such that power is not wasted to pre-charge and then reverse bias each of the light-emitting elements within a row of pixels that will not be activated. Unfortunately, this approach will only reduce power under very specific display conditions and is not generally applicable to large graphic displays, which often employ text on white backgrounds; and, therefore, will rarely display a black line.

While each of the previously discussed approaches attempt to avoid the problems of power dissipation due to pre-charging and reverse biasing the light-emitting elements or reducing the current that any single driver is required to provide, each of these approaches apply the same basic drive technique. A different approach to driving a passive matrix display is employed in WO 2006/035248, filed Sep. 30, 2004 by Smith et al., however, which discusses an approach that allows all of the light-emitting elements of a display to be lit simultaneously. In such an approach, the driver employs a frame buffer to store an input image. This input image is then analyzed and a number of orthogonal pairs of matrices are formed and stored, which may be used to approximately describe the content of the image. One of the matrices in each orthogonal pair is then used to provide a signal to the row drivers while the second of the matrices in the same orthogonal pair is used to provide a signal to the column drivers. These row and column driver inputs are then updated to display each of the orthogonal pairs of matrices during each image update cycle. Using this method, pre-charging and reverse biasing of the light-emitting elements are avoided, reducing the overall power required to drive the passive matrix display and decreasing the instantaneous current load that is required from each of the drivers. Unfortunately, the image processing that is required to create the orthogonal pairs of matrices is significant, especially when such processing must be accomplished in real time and at rates of 30 Hz or higher. Further, the drivers must be equipped with significant memory and be capable of driving each row to several drive voltage levels. These features can add significant cost to the drive electronics, which are required to drive the thin-film EL display, significantly increasing the cost of the overall display system.

There is a need; therefore, for a method of controlling and driving passive-matrix displays that enables the use of lower-cost drivers, reduces the power consumption, and improves the resolution of the passive-matrix display.

SUMMARY OF THE INVENTION

The aforementioned need is met by providing a passive-matrix, thin-film electro-luminescent display system that includes a display having a substrate with organic layers and orthogonally-arranged electrodes formed thereon. One or more display drivers: (i) receives an input image signal for addressing the light-emitting elements of the display; (ii) decomposes the signal into a low-resolution component signal and a high-resolution component signal, wherein the low-resolution component signal contains one half or less of the number of addressable locations as the high-resolution component signal; and (iii) provides a drive signal for driving the display wherein the low-resolution component signal and the high-resolution component signal are independently provided to the display to form a combined image.

BRIEF DESCRIPTION OF THE DRAWINGS

FIG. 5 is a perspective view of stacked light-emitting elements of a passive-matrix display formed on one substrate and sharing an electrode according to an alternative embodiment of the present invention;

FIG. 6 is an illustration of prior-art temporal control of a passive-matrix display;

FIGS. 11A-11D are an illustration of frame-interleaved temporal control of a passive-matrix display according to an embodiment of the present invention;

FIG. 13 is a perspective view of a light-emitting element of a prior-art passive-matrix display; and FIG. 14 is a perspective view of a prior-art passive-matrix display.

DETAILED DESCRIPTION OF THE INVENTION

Figure 1:
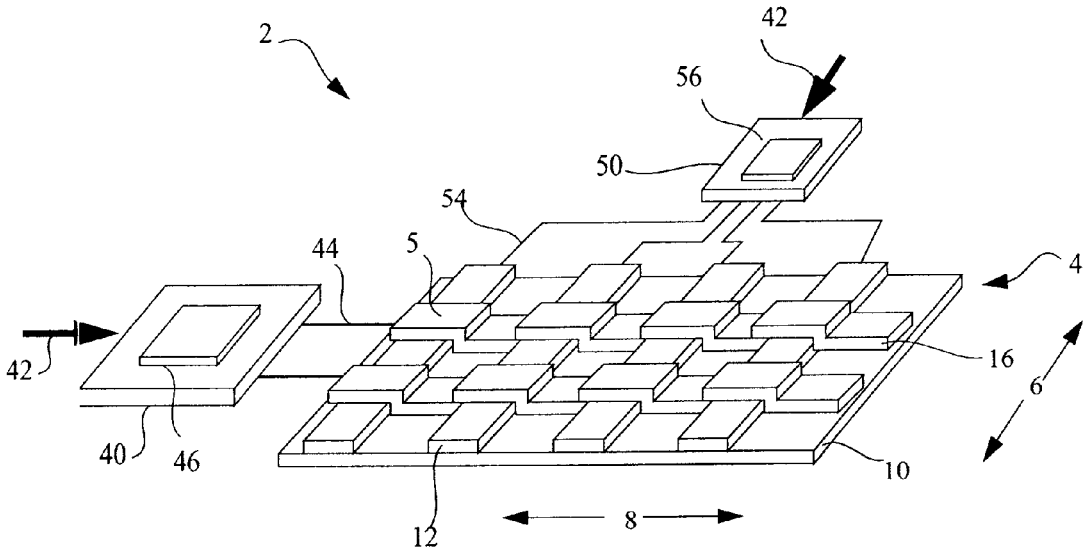
FIG. 1 is a perspective view of a passive-matrix display and controller according to an embodiment of the present invention.
Figure 2:
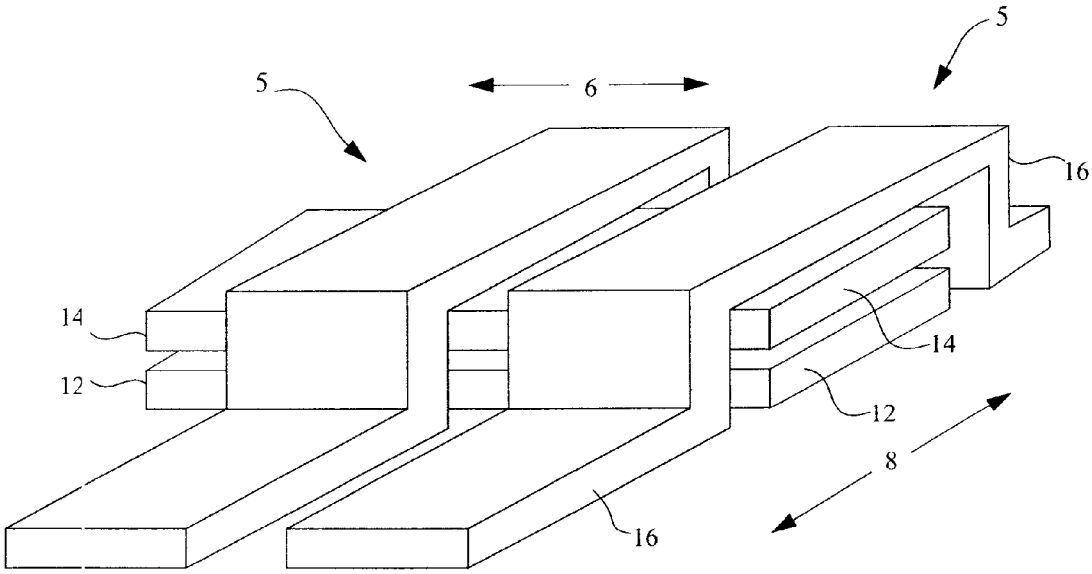
FIG. 2 is a perspective view of a single light-emitting element of a passive-matrix display according to an embodiment of the present invention.

Referring to FIGS. 1 and 2, this need is met by providing a passive-matrix, thin-film electro-luminescent display system 2 having improved efficiency, comprising a display 4 consisting of a substrate 10, a first electrode layer 12 patterned to form lines along a first dimension 6 of the substrate 10, one or more thin-film electro-luminescent layers 14 formed on the first electrode layer 12 and a second electrode layer 16 formed on the one or more thin-film electro-luminescent layer(s) 14 wherein the second electrode layer 16 is patterned to form lines along a second dimension 8 of the substrate 10 different from the first dimension 6 comprising an electro-luminescent unit 5. Individual light-emitting elements 5 are formed at the intersection of the lines of the first and second electrode layers 12 and 16, respectively; and one or more display drivers 40, 50 for receiving an input image signal 42 for addressing the light-emitting elements 5 of the display 4, decomposing the input image signal 42 into a low-resolution component signal and a high-resolution component signal wherein the low-resolution component signal contains one half or less of the number of addressable locations as the high-resolution component signal; and providing a drive signal 44, 54 for driving the display 4. The low-resolution component signal and the high-resolution component signal are independently provided to the display 4 to form a final image such that the refresh rate of the display 4 may be reduced; thereby; reducing the power used to charge the capacitance of the light-emitting elements 5. Alternatively, the passive-matrix display may have greater resolution without requiring an increase in power consumption.

Typically, the first and second electrodes 12, 16 are formed orthogonally over the surface of the display 4 and are often referred to as row and column electrodes. Electrical signals are provided to the first and second electrodes by row driver 46 and column driver 56. These row and column drivers may be a single integrated circuit or, as shown, separate devices. Additional digital logic or analog circuitry (not shown) may be provided to receive an input image signal 42 and to decompose the signal into a low-resolution component signal and a high-resolution component signal which is provided through the row driver 40 and column driver 50. Such circuitry is known in the art, as are methods for forming electrodes and depositing electro-luminescent materials between the electrodes; for example, by employing OLED, PLED, or inorganic light-emitting materials. As described in U.S. Pat. No. 4,769,292, issued Sep. 6, 1988 by Tang et al., and co-pending U.S. Ser. No. 11/226,622 filed Sep. 14, 2005 by Kahen, entitled "Quantum Dot Light Emitting Layer", and incorporated by reference herein. The formation of electrodes in passive-matrix configurations over a substrate is also known, for example, by employing photolithography to pattern the first electrodes 12, evaporative or coating techniques to form the electro-luminescent layer 14, and employing pillars (not shown in FIGS. 1 and 2) to pattern the second electrodes 16. The electro-luminescent layer 14 may emit a single color or a broadband light such as white, or be patterned to emit different colors at different locations over the substrate 10. Color filters may be employed to provide patterned color emission. As described herein, rows and columns are arbitrary designations and may be exchanged in various embodiments of the present invention.

The present invention provides an improved resolution display without increasing the refresh rate or power requirements of the display. Alternatively, the apparent resolution of the display may stay the same while power usage is reduced. The power usage is reduced by requiring fewer charge/discharge cycles of rows or columns or the same number of charge/discharge cycles at a lower refresh frequency, thereby reducing the power required to drive the rows or columns. Because the human visual system (HVS) is sensitive to either high spatial resolution component information at a relatively lower temporal frequency or low spatial resolution information at a relatively higher temporal frequency, but not both at the same time, providing the high-spatial resolution component information at a relatively lower temporal frequency and the low spatial resolution information at a relatively higher temporal frequency apparent display resolution is maintained, while reducing the required refresh rate for the high spatial resolution component information, the power requirements are reduced as compared to a prior-art display having a similar resolution. This limitation serves to take optimal advantage of the bandwidth of the human visual system (HVS) and can be employed to likewise optimize the performance of a passive-matrix display system.

According to the present invention, a passive-matrix display optimized to take advantage of the spatial frequency response of the HVS can include alternating high- and low-resolution component signals driven to a single display. In various embodiments, for example, a low-spatial resolution component signal might be written more often than a high spatial resolution component signal, less often, or at the same frequency. A full frame of each signal type might be temporally interleaved or groups of lines or single lines of each signal type might be temporally interleaved. However, the low spatial resolution component signal will preferably be written more often than the high spatial resolution component signal.

In various embodiments, the concept can be extended to any size display and/or multiple levels of resolution. The low-resolution component lines should be contiguous, generally, since they all receive the same signal. However, they need not be the same lines each time (ignoring top and bottom edge effects). The high-resolution component lines may be chosen arbitrarily. Note that the averaging is only necessary in one dimension, since the same number of columns is employed in the other dimension in either case.

In other embodiments, it is also possible to write high- and low-resolution component to different levels of a stacked display. In a color system, the colors may be treated differently, for example, one may display green high spatial resolution component more frequently than red or blue since both the temporal and spatial resolution of the human visual system tends to be lower for red or blue than for high luminance signals such as green. Likewise, in an RGBW system, white might get more high-resolution component signals.

According to various embodiments of the present invention, a variety of means may be employed to form the electro-luminescent elements 5. In one embodiment, for example, as illustrated in FIGS. 1 and 2, the high- and low-resolution signals may be alternately provided to a display 4 having one electro-luminescent element 5 formed over each location on a substrate 10. In an alternative embodiment, illustrated in FIG. 3, electro-luminescent elements 5 may be formed on either side of a substrate 10 by employing an additional first electrode 13, additional electro-luminescent layer 18, and additional second electrode 20 on a second side of the substrate 10.

Figure 4:
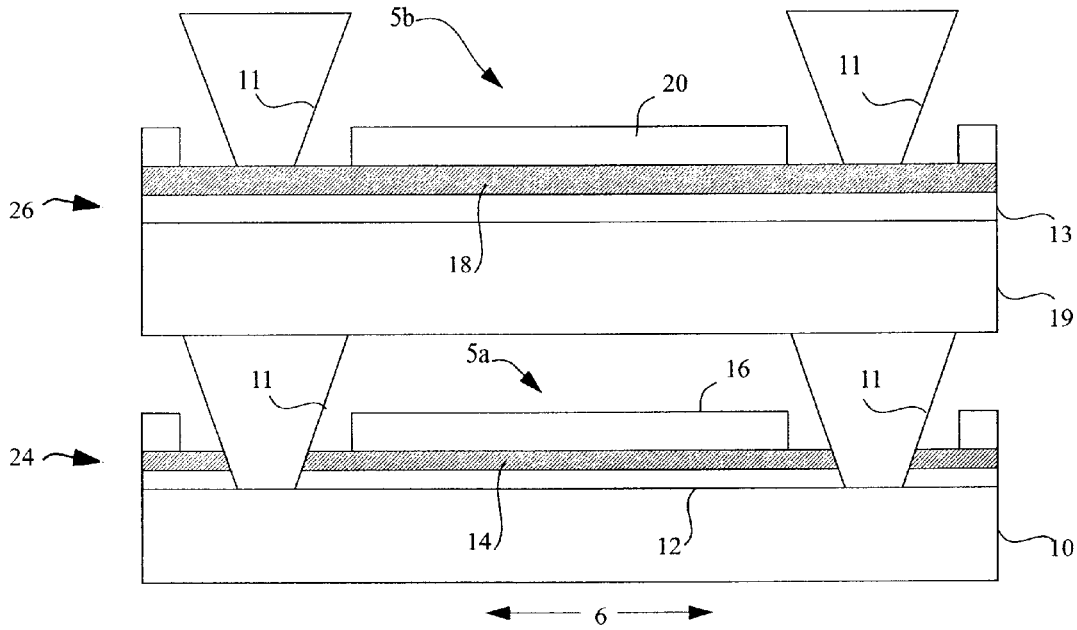
FIG. 4 is a cross section of stacked light-emitting elements of a passive-matrix display formed on two substrates according to an alternative embodiment of the present invention.

In yet another embodiment, illustrated in FIG. 4, the display may further comprise a second substrate 19. A first plurality of electro-luminescent elements 5*a* in a first stack layer 24 are formed on the first substrate 10 and is driven by the low-resolution component signal while a second plurality of electro-luminescent elements 5*b* in a second stack layer 26 are formed on the second substrate 19 and is driven by the high-resolution component signal. Alternatively, the high- and low-resolution elements may be exchanged with respect to the first and second substrates 19. As illustrated in FIG. 4, the second substrate 19 is located on the patterning pillars 11; however, the second substrate 19 is not limited to that location and may be located anywhere above (or below) the first substrate 10. To provide a visible image combining the high- and low-resolution images, the substrates and electrodes through which light travels should preferably be transparent. Typically this implies that the back substrate and/or electrode may be opaque or reflective while the others are transparent. The location of the reflective or opaque electrode depends upon whether the device is intended to be a top- or a bottom-emitting device. Note that the first stack layer 24 and the second stack layer 26 are oriented such that one is viewed through an additional substrate 19 as compared to the other. In other embodiments, additional layers that may serve as an insulator may be placed over the top of one or both of the first and second stack layers 24, 26, to provide electrical insulation and the first and second stack layers 24, 26 may be arranged such that both substrates 10, 19 are external to the device and provide a means for creating physical protection of the active areas of the device.

In an alternative embodiment illustrated in FIG. 5, two electro-luminescent elements may be stacked on top of each other and share a common electrode 16. Such structures and means for driving them are discussed in more detail in commonly assigned, co-pending U.S. patent application Ser. No. 11/536,712, filed Sep. 29, 2006 by Cok, which is hereby incorporated in its entirety by reference. In such a structure, the display further comprises one or more thin-film electro-luminescent layers 18 which together comprise a second electro-luminescent unit and at least a third electrode layer 20 and wherein the low-resolution component signal is used to drive a first electro-luminescent unit at a first refresh rate and the high-resolution component signal is used to drive a second electro-luminescent unit at a second refresh rate.

Figure 3:
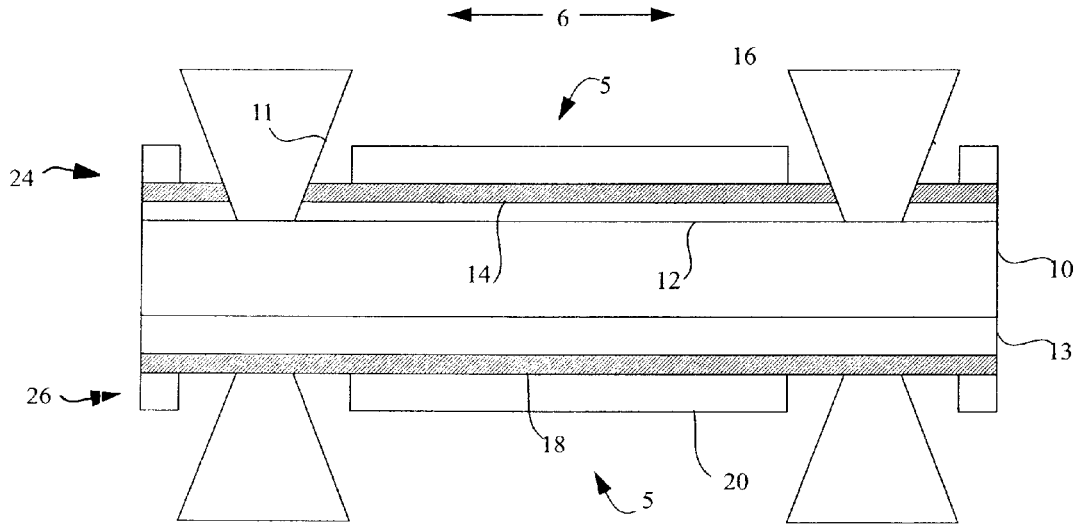
FIG. 3 is a cross section of stacked light-emitting elements of a passive-matrix display formed on opposite sides of a single substrate according to an alternative embodiment of the present invention.

In the embodiments of FIGS. 3, 4, and 5, the first plurality of electro-luminescent elements are shown formed at the same resolution on the first substrate as the second plurality of electro-luminescent elements formed on the second substrate (or on the other side of the same substrate). In alternative embodiments, the first plurality of electro-luminescent elements may be formed at a relatively lower resolution on the first substrate and the second plurality of electro-luminescent elements are formed at a relatively higher resolution on the second substrate. Alternatively, if the substrate comprises two sides (as shown in FIG. 3), the first plurality of electro-luminescent elements formed on a first side of the substrate may be driven by the low-resolution component signal and the second plurality of electro-luminescent elements formed on the second side of the substrate may be driven by the high-resolution component signal. While the present invention may employ a common refresh rate for both the high- and the low-resolution signals, in some embodiments of the present invention, the refresh rates for the high- and the low-resolution signals may be different. In simpler embodiments, the refresh rates may differ by integral values or by multiples of each other. In particular, the first refresh rate may be at least twice the second refresh rate.

In general, according to the present invention, either the rows or columns of a display may be driven at different refresh rates, or both may be driven at different refresh rates. Alternatively, multiple light-emitting elements along both dimensions of the display may be activated when the low-resolution component signal is provided to the display and multiple light-emitting elements along only one dimension of the display are activated when the high-resolution component signal is provided to the display. In yet another alternative, the low-resolution signal may drive a plurality of contiguous elements in one or more rows or columns simultaneously with the same signal and the high-resolution signal alternately drives one row or column.

In other embodiments of the present invention, the low-resolution signal may be displayed more frequently than the high-resolution signal. The low-resolution signal and high-resolution signal may be interleaved full-frame signals or the low-resolution signal and high-resolution signals are interleaved row or column signals.

In the embodiment of the present invention in which the electro-luminescent elements are not stacked (e.g. FIGS. 1, 2), the low-and high-resolution signals may be alternately displayed on the electro-luminescent elements. In this case, it is useful to group the rows or columns into disjoint sets of contiguous rows or columns, respectively, and the low-resolution signal is displayed on some or all of the rows or columns in the group and the high-resolution signal is alternately and cyclically displayed on one or more of the rows or columns, respectively, in the group. Alternatively, the rows or columns may be grouped into a plurality of disjoint sets of contiguous rows or columns, respectively, and the low-resolution signal is displayed on some or all of the rows or columns in the group and the high-resolution signal is alternately displayed on one or more of the rows or columns in a different group.

Referring to FIG. 6, the operation of a prior-art passive-matrix display having four rows is illustrated. In this Figure (and FIGS. 7, 8, 10, 11), each column is labeled with a different time period and each time-labeled column represents an entire display driven at the time period indicated. The arrows indicate a temporal sequence. Only the rows are shown and all of the light-emitting elements in each row are operated simultaneously where indicated by a dotted pattern for a low-resolution component signal and a slash pattern for a high-resolution component signal. The orthogonal columns overlapping the rows to form light-emitting elements are not illustrated (except in FIG. 9). As shown in the prior-art illustration of FIG. 6, at t0, the first row is controlled with a signal to emit light (in concert with the column control signal, not shown). At t1, the second row is operated, at t2 the third row is operated, and at t3 the fourth row is operated. All of the light-emitting elements are operated in four time periods comprising a frame refresh cycle, and then the process repeats. The periods are made short enough that an observer does not perceive flicker from the temporally sequential energizing of the rows.

Figure 7A:
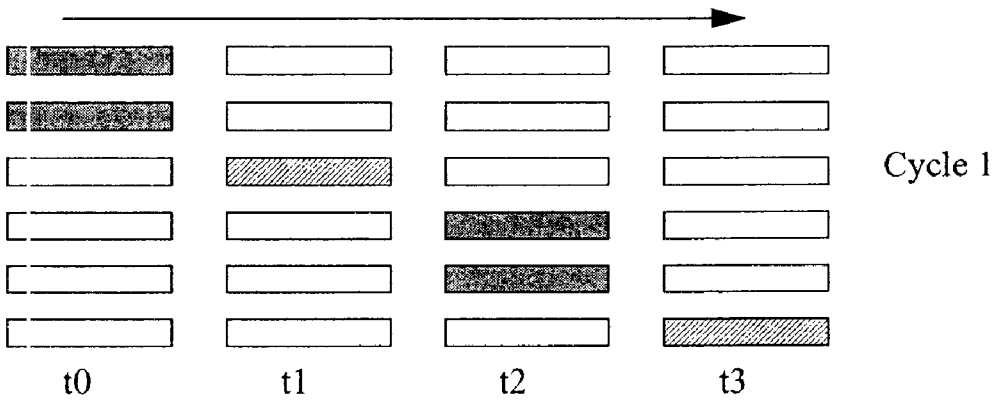
FIGS. 7A-7C are an illustration of row-interleaved temporal control of a passive-matrix display according to an embodiment of the present invention.
Figure 7B:
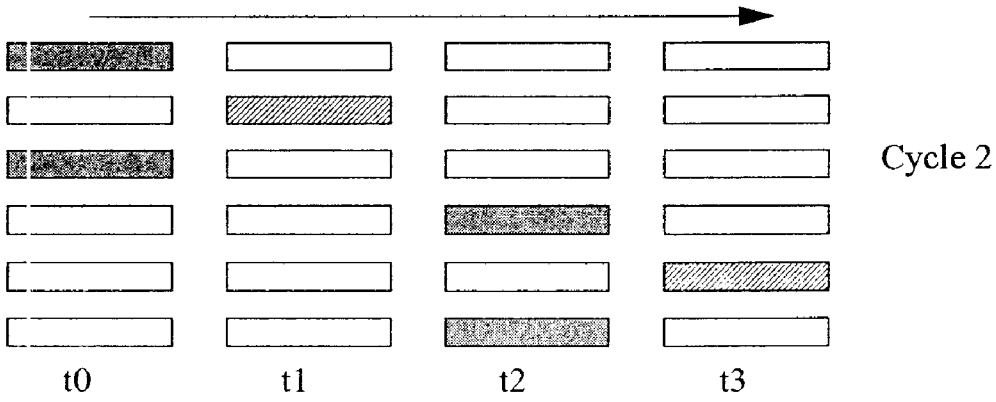
Figure 7C:
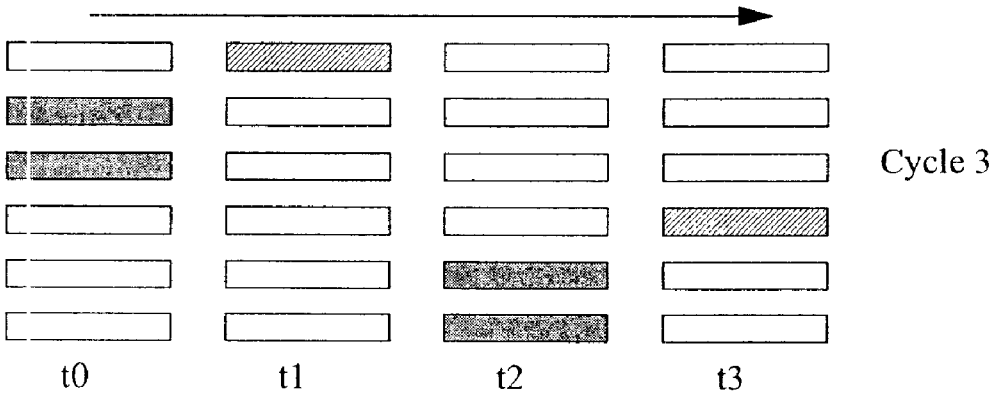

According to one embodiment of the present invention and as illustrated in FIGS. 7A-7C, a six-row display having improved resolution is operated for three refresh cycles having four periods each, thereby demonstrating improved resolution of the display device using the same time and power as the display of FIG. 6. Referring to FIG. 7A, at t0 the first two rows are operated with a low-resolution component signal. In particular, the two rows are energized with the same column signal, allowing them to be operated simultaneously. This common, low-resolution component signal may be the average of the signals for each row, the minimum value of each row the signal for one row or the other or some proportion of one of these quantities. Because the same signal is supplied to two rows, the signal will effectively reduce the resolution of the image provided on the rows, that is a low-resolution component signal is provided. At t1, a high-resolution component signal is provided to row 3. The high-resolution component signal may simply be the original row signal. At t2, a low-resolution component, common signal is provided to rows four and five, and at t3 a high-resolution component signal is provided to row 6.

Figure 8:
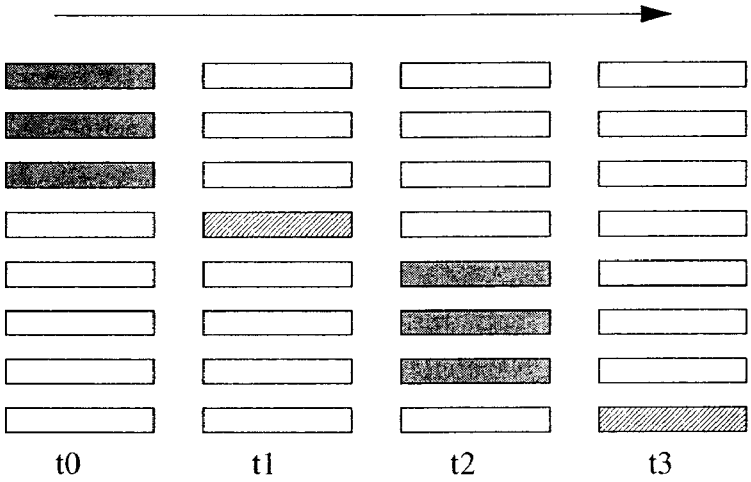
FIG. 8 is an illustration of row-interleaved temporal control of a passive-matrix display according to an alternative embodiment of the present invention.

In a second refresh cycle of the same display and illustrated in FIG. 7B, the first and third rows are operated with a common signal at time t0, a high-resolution component signal is supplied to row two at t1, the fourth and sixth rows are operated at time t2 with a common signal, and at t3 a high-resolution component signal is provided to row 5. In a third refresh cycle illustrated in FIG. 7C, a similar procedure is followed, except that the high-resolution component signals are applied to rows one and four, and the low-resolution component signals are supplied to rows two and three and to rows five and six. While it is not necessary that the high-resolution component signals cycle through all of the rows, improved appearance and reduced flickering will result if such cycling is employed. The order of the cycles is not critical. The process may be extended to displays having more rows and low-resolution component signals may also be provided, for example, as shown in FIG. 8 for a single frame cycle, three or more rows may be averaged together for the low-resolution component signal and fewer high-resolution component signals provided relative to the number of low-resolution component signals.

Figure 9:
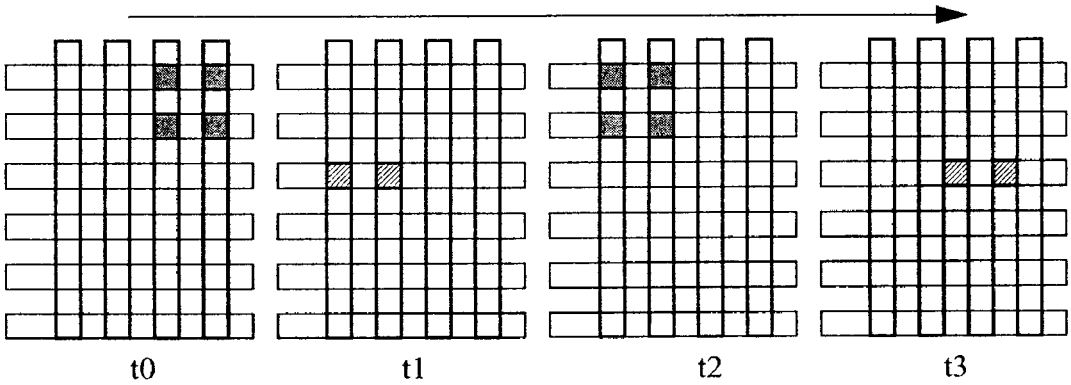
FIG. 9 is an illustration of two-dimensionally interleaved temporal control of a passive-matrix display according to another embodiment of the present invention.

Referring to FIG. 9, for a single frame cycle, all of the light-emitting elements within a row may not be operated at one time. By separately controlling the column drivers, a two-dimensional subset of the light-emitting elements may be driven in common with a low-resolution component signal (as shown at t0 and t2) and a two-dimensional subset likewise driven with a high-resolution component signal (as shown at t1 and t3). Alternatively, one or the other of the high- and low-resolution component signals may include all of the elements in one or more rows; and the other of the high- and low-resolution component signals may include a two-dimensional subset.

Figure 10:
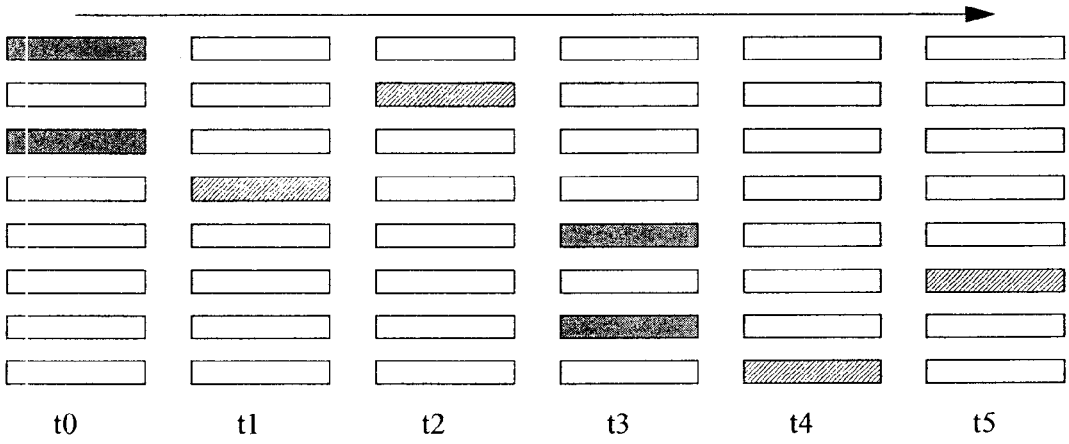
FIG. 10 is an illustration of row-interleaved temporal control of a passive-matrix display according to another alternative embodiment of the present invention.

Referring to FIG. 10, the refresh rate of the high-resolution component signal may differ from the refresh rate of the low-resolution component. As illustrated in FIG. 10, rows one and three may be simultaneously driven at t0 with a common low-resolution component signal. At t1, row four may be driven with a high-resolution component signal, and at t2 row two may be driven with a high-resolution component signal. During periods t3 through t5, a similar scheme may be employed for rows five through eight. In this case the high-resolution component signals are driven twice as often as the low-resolution component signals. Note that in this illustration, the display has eight rows and six time periods are used for a frame refresh cycle. Alternatively, by driving the low-resolution signal in periods t1 and t2, and then again in t4 and t5, and driving the high-resolution signal periods t0 and t3, the low-resolution component signals are driven twice as often as the low-resolution component signals.

The example embodiments of FIGS. 7-10 employ alternate low and high-resolution signals by rows or groups of rows. In an alternative embodiment, the entire display including all of the light-emitting elements may be driven first by the low-resolution signal and then the entire display, including all of the light-emitting elements, may be driven secondly by the high-resolution signal (or vice versa). Referring to FIG. 11A-D, a display having eight rows driven in four time periods comprising a frame refresh cycle is shown. In FIG. 11A, at time t0, the first two rows are driven with a common, low-resolution signal, at time t1 rows three and four are similarly driven, then rows five and six, followed by rows seven and eight. This frame cycle effectively drives the entire display with a low-resolution component signal in four periods. In a second frame cycle (FIG. 11B), every other row is driven with a high-resolution component signal. In a third frame cycle (FIG. 11C), the low-resolution component signal is applied again (illustrated here with different temporal row ordering) and in the fourth cycle (FIG. 11D) the rows not driven in the second frame cycle (FIG. 11B) are driven with the high-resolution component signal. It is also possible to drive the display with relatively more low-resolution component signals, for example, by driving the display according to the order of frame cycles of FIGS. 11A, 11C, 11B, 11A, 11C, 11D and so on. Alternatively, it is also possible to drive the display with relatively more high-resolution component signals, for example by driving the display according to the order of frame cycles of FIGS. 11A, 11B, 11D, 11C, 11B, 11D and so on.

In any of the example embodiments presented, the ordering of the rows presented may be varied.

Figure 12:
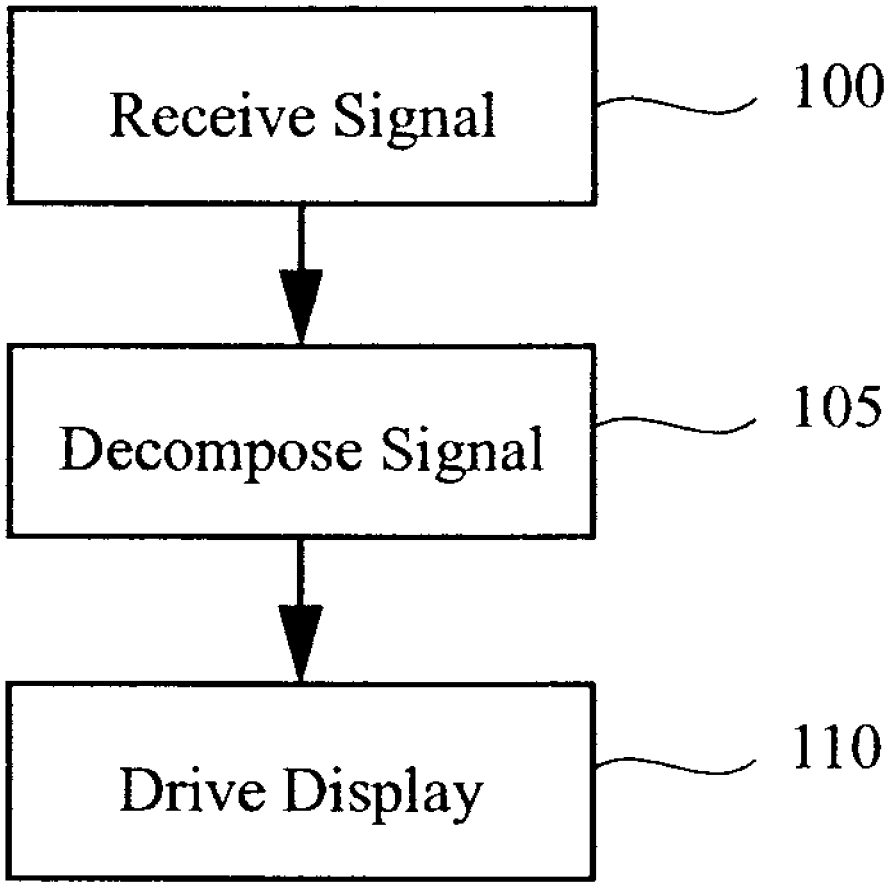
FIG. 12 is a flow diagram illustrating a method of the present invention.

According to a method of the present invention illustrated in FIG. 12, a passive-matrix display may be controlled by receiving an input image signal in operation 100 for addressing the light-emitting elements of the display. Operation 105 decomposes the input image signal into a low-resolution component signal and a high-resolution component signal, wherein the low-resolution component signal contains one half or less of the number of addressable locations as the high-resolution component signal. Operation 110 provides a drive signal for driving the display wherein the low-resolution component signal and the high-resolution component signal are independently provided to the display to form a final image.

In a preferred embodiment, the present invention is employed in a flat-panel OLED device composed of small molecule or polymeric OLEDs as disclosed in but not limited to U.S. Pat. No. 4,769,292, issued Sep. 6, 1988 to Tang et al., and U.S. Pat. No. 5,061,569, issued Oct. 29, 1991 to VanSlyke et al. Many combinations and variations of organic light-emitting displays can be used to fabricate such a device, including passive-matrix OLED displays having either a top- or bottom-emitter architecture.

The invention has been described in detail with particular reference to certain preferred embodiments thereof, but it will be understood that variations and modifications can be effected within the spirit and scope of the invention.

PARTS LIST

2 display system
4 display
5, 5*a*, 5*b* electro-luminescent element
6 first dimension
8 second dimension
10 substrate
11 pillar
12 first electrode
13 first electrode
14 layer of electro-luminescent material
16 second electrode
18 second layer of electro-luminescent material
19 second substrate
20 second electrode
24 first stack layer
26 second stack layer
40 driver
42 input signal
44 drive signal
46 circuit
50 driver
52 input signal
54 drive signal
56 circuit
100 receive signal step
105 decompose signal step
110 drive display step

What is claimed is:

1. A passive-matrix, thin-film electro-luminescent display system, comprising:

a) a display including:

i) a substrate;

ii) a first electrode layer patterned to form lines along a first dimension of the substrate;

iii) one or more thin-film electro-luminescent layers, formed on the first electrode layer;

iv) a second electrode layer formed on the one or more thin-film electro-luminescent layer(s), wherein the second electrode layer is patterned to form lines along a second dimension of the substrate different from the first dimension;

v) wherein the intersection of the lines of the first and second electrode layers define individual light-emitting elements comprising an electro-luminescent unit; and b) one or more display drivers that i) receives an input image signal for addressing the light-emitting elements of the display;

ii) decomposes the signal into a low-resolution component signal and a high-resolution component signal, each of which consists of different addressable locations during a single frame cycle, wherein the low-resolution component signal contains one half or less of the number of the addressable locations as the high-resolution component signal, and the low-resolution component signal and the high-resolution component signal are driven alternately; and iii) provides a drive signal for driving the display wherein the low-resolution component signal and the high-resolution component signal are independently provided to the display to form a combined image.

2. The display according to claim 1, wherein multiple light-emitting elements along both dimensions of the display are activated when the low-resolution component signal is provided to the display and multiple light-emitting elements along only one dimension of the display are activated when the high-resolution component signal is provided to the display.

3. The display according to claim 1, wherein the display further comprises one or more thin-film electro-luminescent layers and at least a third electrode layer which together comprise a second electro-luminescent unit and wherein the low-resolution component signal is used to drive a first electroluminescent unit at a first refresh rate and the high-resolution component signal is used to drive a second electro-luminescent unit at a second refresh rate.

4. The display according to claim 3, wherein the first refresh rate is at least twice the second refresh rate.

5. The display according to claim 1, wherein the display further comprises a second substrate and wherein a first plurality of electroluminescent units are formed on the first substrate and is driven by the low-resolution component signal and a second plurality of electroluminescent units are formed on the second substrate and is driven by the high-resolution component signal.

6. The display according to claim 5, wherein the first plurality of electroluminescent units are formed at a relatively lower resolution on the first substrate and the second plurality of electroluminescent units are formed at a relatively higher resolution on the second substrate.

7. The display according to claim 1, wherein the substrate comprises two sides and wherein a first plurality of electroluminescent units are formed on a first side of the substrate and is driven by the low-resolution component signal and a second plurality of electroluminescent units are formed on the second side of the substrate and is driven by the high-resolution component signal.

8. The display according to claim 1, wherein the low-resolution signal drives a plurality of contiguous elements in one or more rows or columns simultaneously with the same signal and the high-resolution signal alternately drives one row or column.

9. The display according to claim 1, wherein the low-resolution signal is displayed more frequently than the high-resolution signal.

10. The display according to claim 1, wherein the low-resolution signal and high-resolution signal are interleaved full-frame signals.

11. The display according to claim 1, wherein the low-resolution signal and high-resolution signal are interleaved row or column signals.

12. The display according to claim 1, wherein the rows or columns are grouped into disjoint sets of contiguous rows or columns, respectively, and the low-resolution signal is displayed on some or all of the rows or columns in the group and the high-resolution signal is alternately and cyclically displayed on one or more of the rows or columns, respectively, in the group.

13. The display according to claim 1, wherein the rows or columns are grouped into a plurality of disjoint sets of contiguous rows or columns, respectively, and the low-resolution signal is displayed on some or all of the rows or columns in the group and the high-resolution signal is alternately displayed on one or more of the rows or columns in a different group.

14. The display according to claim 1, wherein display is a color display comprising different electro-luminescent that emit different colors of light and wherein the refresh rate for electro-luminescent elements that emit one color of light is different from the refresh rate for electroluminescent elements that emit a different color of light.

15. The display according to claim 14, wherein the refresh rate for electro-luminescent elements that emit green or white light is higher than the refresh rate for electro-luminescent elements that emit red or blue light.

16. The display according to claim 10, wherein electro-luminescent layers are layers of OLED materials.

* * * * *